US005576158A

United States Patent [19]

Ford et al.

[11] Patent Number: 5,576,158

[45] Date of Patent: Nov. 19, 1996

[54] COLOR PHOTOGRAPHIC REVERSAL ELEMENT WITH IMPROVED COLOR REPRODUCTION

[75] Inventors: Frederick E. Ford, Victor; Arlyce T. Bowne, Rochester; Carl Kotlarchik, Jr., Spencerport, all of N.Y.

[73] Assignee: Eastman Kodak Company, Rochester, N.Y.

[21] Appl. No.: 311,798

[22] Filed: Sep. 26, 1994

Related U.S. Application Data

[63] Continuation of Ser. No. 5,474, Jan. 15, 1993, Pat. No. 5,378,590.

[51] Int. Cl.[6] ..... G03C 1/46

[52] U.S. Cl. ..... 430/504; 430/505; 430/506; 430/544; 430/957; 430/359; 430/379

[58] Field of Search ..... 430/505, 504, 430/506, 544, 957, 407, 359, 379, 567

[56] References Cited

U.S. PATENT DOCUMENTS

| | | | |
|---|---|---|---|
| 3,990,899 | 11/1976 | Shiba et al. | 430/359 |
| 4,273,861 | 6/1981 | Shiba et al. | 430/359 |
| 4,729,943 | 3/1988 | Pfaff et al. | 430/362 |
| 5,024,925 | 6/1991 | DeGuchi | 430/505 |
| 5,051,345 | 9/1991 | Haraga et al. | 430/505 |
| 5,262,287 | 11/1993 | DeGuchi et al. | 430/504 |
| 5,378,590 | 1/1995 | Ford et al. | 430/504 |
| 5,380,633 | 1/1995 | Harder et al. | 430/505 |

FOREIGN PATENT DOCUMENTS

| | | |
|---|---|---|
| 296784 | 6/1988 | European Pat. Off. . |
| 296785 | 6/1988 | European Pat. Off. . |
| 442323 | 1/1991 | European Pat. Off. . |

*Primary Examiner*—Geraldine Letscher
*Attorney, Agent, or Firm*—Gordon M. Stewart; Sarah Meeks Roberts; Arthur H. Rosenstein

[57] ABSTRACT

A color reversal photographic element comprises a support bearing a red-sensitive, cyan dye-forming unit, a green-sensitive, magenta dye-forming unit, and a blue-sensitive, yellow dye-forming unit, each unit comprising a photosensitive silver halide layer and an image-dye forming coupler; the element contains an interimage effect-controlling means which is characterized as having the capability of simultaneously forming a red image of high relative chroma and a yellow-red tint image of substantially lower relative chroma when the element is exposed to a red color standard object having CIELab values for $D_{55}$ reference white a*=30.46, b*=19.16, C*=35.98, L*=40.12 and a yellow-red tint color standard object having CIELab values for $D_{55}$ reference white a*=17.26, b*=18.01, C*=24.95, L*=66.98; the resulting images have a red reproduction coefficient equal to or greater than 0.88 and a ratio of red reproduction coefficient to yellow-red tint reproduction coefficient equal to or greater than 1.15.

16 Claims, No Drawings

COLOR PHOTOGRAPHIC REVERSAL ELEMENT WITH IMPROVED COLOR REPRODUCTION

This is a continuation of U.S. application Ser. No. 005,474, filed 15 Jan. 1993, U.S. Pat. No. 5,373,590.

CROSS-REFERENCE TO RELATED APPLICATIONS

Reference is made to the following copending, commonly assigned applications: "Image Formation in Color Reversal Materials Using Strong Inhibitors," U.S. Ser. No. 08/004,027, filed Jan. 15, 1993; "Photographic Elements Having Fogged Grains and Development Inhibitors for Interimage," U.S. Ser. No. 08/005/472, filed Jan. 15, 1993.

FIELD OF THE INVENTION

The present invention relates to the improvement of color reproduction in color photographic reversal elements. More specifically, this invention relates to an element that reproduces red colors with higher relative chroma while reproducing a yellow-red tint image of a standard test object with lower relative chroma.

BACKGROUND OF THE INVENTION

A photographic element for color photography usually comprises three silver halide photosensitive units sensitive to blue, green and red light that are respectively associated with yellow, magenta and cyan dye-forming compounds. Particularly useful dye-forming compounds are color-forming couplers. With this type of material, it is well known that color reproduction is often imperfect because of unwanted absorption of the dyes formed from the couplers. Furthermore, as described hereinafter, the development of silver halide in one of the emulsion layers during processing may affect dye formation in an adjacent layer.

In elements for color photography having three units with incorporated couplers, the three units respectively sensitive to blue, green and red light should be protected from undesirable interactions during storage, exposure and development with a view to obtaining excellent color reproduction. In addition, the spectral absorption of the dye formed from each incorporated color-forming coupler should be located in an appropriate wavelength range. These are well-known conditions to form a satisfactory color image. However, it is also known that elements for color photography exhibit various defects related to the difficulty of meeting these requirements.

As previously mentioned, one of the defects relating to color image reproduction is that the spectral absorption characteristics of the subtractive color images obtained from color-forming couplers are not satisfactory; i.e., the light absorption of the image dyes is not confined to a desired region of the spectrum and extends to other regions of shorter or longer wavelengths. There can also be overlap in the sensitizations of the associated silver halide emulsions. These defects result in degradation of colors.

Another defect arises because, during color development of the three color image-forming emulsion layers, the development of an image in one of the layers may cause unwanted formation of color in an adjacent emulsion layer intended by definition to record another image. For example, the development of the magenta image of the green-sensitive layer may cause formation of cyan dye in the red-sensitive layer, but following the pattern of the magenta image. This defect results from the fact that the oxidation products of development of one of the layers may diffuse to an adjacent layer where they would give rise to an unwanted coupling with the coupler present in this layer.

The above-mentioned defects cause what is sometimes referred to by the term "color contamination." The reaction for forming a dye image in a given emulsion layer affects the adjacent emulsion layers whereby the latter lose their aptitude to form independent elementary images and causes in these layers the formation of unwanted dye images by color contamination.

Because the problem has been acknowledged for a long time, various means have been recommended in the prior art to reduce or eliminate these color-contamination defects. For example, it has been proposed to incorporate in color image-forming photographic materials intermediate layers, or filter layers, comprising reducing compounds such as a hydroquinone or a phenol derivative, a scavenger for oxidized color-developing agent, couplers forming colorless compounds, or colored couplers forming diffusible dyes. However, none of these methods has been completely satisfactory.

Another method employs a development inhibitor-releasing, or DIR coupler, as described by Barr, Thirtle and Vittum in *Photog. Sci. and Eng.*, Vol. 13, pages 74–80 and 214–217 (1969), and in U.S. Pat. No. 3,227,554. Generally, the DIR coupler releases in a layer an inhibitor pattern in accordance with the image formed in this layer, but which migrates into an adjacent layer, as described, for example, in U.S. Pat. Nos. 3,990,899 and 4,273,861. Thus, the DIR coupler provides a correction effect usually designated as an interlayer interimage effect. Such an effect may be accompanied by a strong intralayer inhibiting effect on development that necessitates a substantial increase in silver coverage. Because the DIR coupler has a limiting effect on development, the use of such a coupler can reduce contrast and maximum density.

Another method consists in changing the composition of the halides used in each layer respectively sensitive to blue, green and red light of the color photographic material by adjusting, for example, the proportion of iodide ions used in relation to bromide ions. This correction method is that traditionally used for color reversal photographic materials, and consists in causing an interimage effect during the first black-and-white development by the action of the iodide ions released from the developing silver haloiodide emulsions. In this method, however, the emulsion layers containing iodide ions are both causing and receiving interim age effects, so control of this effect can be difficult.

The very multiplicity of correction methods implies that none of them has been fully satisfactory. This is also true for other methods, known to have an influence on color correction, which entail variations in amounts of developing agents, sulfite ions, hydrogen ions, or buffering agents.

Positive dye image-forming reversal photographic materials have features different from those of negative dye image-forming photographic materials. For example, color reversal films have higher contrasts and shorter exposure latitudes than color negative film. Gammas for reversal films are generally between 1.5 and 2.0, which are substantially higher than those of negative films. Negative materials are processed, after image exposure, directly with a chromogenic developer that color develops the negative exposed areas. On the other hand, reversal materials, after imagewise exposure, are first processed with a black-and-white developer that develops a silver image in the negative exposed areas. This is followed by a reversal fogging step, a second overall exposure or a chemical fogging step, and then development with a chromogenic developer to form a positive color image.

In negative dye image-forming photographic materials, interim age effects are always obtained during chromogenic development. In positive dye image-forming reversal photographic materials, interimage effects are generally obtained, as mentioned above, during processing by the release in the first black-and-white developer of a development inhibitor as a function of the silver development of the image-forming layers. The most generally used development inhibitor consists of iodide ions released as a result of the development of silver haloiodide, for example, silver bromoiodide emulsions. EP Application No. 442323, for example, discloses a color photographic reversal material whose total light-sensitive silver halide grains have an average silver iodide content of about 5.5 mole percent or less and a pair of light-sensitive silver halide emulsion layers having differing color sensitivity and a difference of at least 1 mole percent in average silver iodide content, and which has as an object the reproducibility of shades of colors in high density areas.

To obtain interimage effects in dye image-forming reversal photographic materials, the formation of interimage effects in the second chromogenic developer by development inhibitors, such as iodide ions or mercaptans released from incorporated DIR couplers, has generally been avoided because poor results have been obtained. For example, if a DIR coupler is incorporated in a dye image-forming layer of a reversal photographic material, increased granularity of the color positive image may result.

When DIR compounds are proposed for use in color reversal materials, it has been suggested that color development be limited, for example, by reducing development time. It has also been proposed in U.S. Pat. Nos. 4,729,943 and 5,051,345 and in European Patent Application No. 296,784 that, for purposes of improved color reproducibility, a DIR compound be utilized in a layer that contains a silver halide emulsion but does not contribute to image formation. The use of DIR compounds with specific types of couplers, for example, pyrazoloazole magenta couplers in EP Application No. 296,785, has also been proposed.

All of these suggestions of prior workers have serious drawbacks. For example, any technique that employs an extra silver halide emulsion layer has some obvious drawbacks. Silver halide use is increased, which adds to the cost of production and to the cost of film processing. Moreover, addition of an additional layer adds to film thickness, and this increases light scattering during exposure. Light scattering decreases image sharpness, and thus an increase in film thickness is not desired in color reversal film technology.

This invention can be used to overcome the disadvantages discussed above. Furthermore, a very significant advantage of this invention is that it allows use of standard processes such as the Kodak E-6 development process without modification. That process provides the advantages inherent in using all, or nearly all, of the exposed silver to form the image obtained from the exposed film. The E-6 process is commonly employed today; it and substantially equivalent processes made available by other manufacturers are so widely used that films are designed to be satisfactorily developed by these processes. In most instances the E-6 process, or a substantially equivalent process, is the only reversal process used by a business entity that develops reversal film. Accordingly, this invention has inherent advantages over any prior art suggestion that necessarily involves the use of a modified color reversal process.

Moreover, any previously proposed use of DIR compounds in color reversal systems that requires the use of a specific type of magenta coupler, severely limits the proposed system by making it less than generally applicable. This invention, which does not require specific types of couplers, has broad applicability.

PROBLEM TO BE SOLVED BY THE INVENTION

The methods described heretofore for improving color reproduction in color reversal materials do not allow the reproduction of colors with higher chroma without an undesirably large increase in the chroma of similar colors of lower chroma. The large number of commercial color reversal films produced by various manufacturers typically suffer from this color reproduction deficiency. The present invention provides a color photographic reversal element that simultaneously reproduces a yellow-red tint color, such as a skin tone, with a lower relative chroma and a red color with a disproportionately higher relative chroma.

SUMMARY OF THE INVENTION

In accordance with the invention, there is provided a color reversal photographic element comprising a support bearing a red-sensitive, cyan dye-forming unit, a green-sensitive, magenta dye-forming unit, and a blue-sensitive, yellow dye-forming unit, each unit comprising a photosensitive silver halide layer and an image dye-forming coupler; said element containing an interimage effect-controlling means; said interimage effect-controlling means being characterized as having the capability of simultaneously forming a red image of high relative chroma and a yellow-red tint image of substantially lower relative chroma when said element is exposed to a red color standard object and a yellow-red tint color standard object and thereafter developed; said red color standard object having CIELab values for $D_{55}$ reference white $a^*=30.46$, $b^*=19.16$, $C^*=35.98$, $L^*=40.12$; said yellow-red tint color standard object having CIELab values for $D_{55}$ reference white $a^*=17.26$, $b^*=18.01$, $C^*=24.95$, $L^*=66.98$; the resulting said images having a red reproduction coefficient equal to or greater than 0.88 and a ratio of red reproduction coefficient to yellow-red tint reproduction coefficient equal to or greater than 1.15.

ADVANTAGEOUS EFFECT OF THE INVENTION

The color reversal photographic element of the present invention provides the simultaneous reproduction of a red color of high relative chroma and pleasing rendition of a yellow-red tint color, such as a skin tone.

DETAILED DESCRIPTION OF THE INVENTION

In accordance with the invention, a dye-forming unit of a color reversal photographic element comprises at least one light-sensitive silver halide emulsion layer and at least one dye-forming coupler and can optionally include a substantially light-insensitive hydrophilic colloid layer. In a preferred embodiment, a dye-forming unit contains two silver halide emulsion layers of differing sensitivity. The layer of lower sensitivity is generally designated as "slow", that of higher sensitivity as "fast". In addition to silver halide and a coupler, a dye-forming unit can contain additional substances such as scavengers, stabilizers, absorber dyes, antifoggants, hardeners, solvents, and the like. Dye-forming units can be separated from one another by intermediate layers, which can contain scavengers, antifoggants, dyes, colloidal silver, and the like. In addition to dye-forming units and intermediate layers, the photographic element of the invention can also contain additional layers such as antihalation layers, protective layers, and the like.

In one embodiment of the invention, a three-color reversal element has the following schematic structure:

(13) Second protective layer containing matte

(12) First protective layer containing UV-absorbing dyes

(11) Fast blue-sensitive layer containing blue-sensitive emulsion and yellow coupler

(10) Slow blue-sensitive layer containing blue-sensitive emulsion and yellow coupler (9) Yellow filter layer (8) Intermediate layer (7) Fast green-sensitive layer containing green-sensitive emulsion and magenta coupler (6) Slow green-sensitive layer containing green-sensitive emulsion and magenta coupler (5) Intermediate layer (4) Fast red-sensitive layer containing red-sensitive emulsion and cyan coupler (3) Slow red-sensitive layer containing red-sensitive emulsion and cyan coupler (2) Intermediate layer (1) Antihalation layer Support with subbing layer The methods described in the prior art for the improvement of color reproduction in color reversal photographic materials by the operation of interlayer interimage effects am incapable of simultaneously producing similar colors of high and low relative chroma because the resulting increases in the chroma of the reproduction of the higher chroma colors are typically accompanied by undesirably large increases in the lower chroma colors. Thus, for example, increasing the chroma of reproduced red objects is achieved with an attendant unpleasing increase in chroma of skin tones, relative to those of the original objects.

To overcome this undesirable result, an element of the present invention provides non-linear interimage effects that are enhanced in the upper region of the positive sensitometric dye scale relative to the lower portion of the scale. In accordance with the present invention, this is achieved either by increasing chroma in the high dye density region and/or decreasing chroma in the low dye density region. The interimage effect-controlling means can operate in the nonochromogenic development step of the process, or in the chromogenic development step, or in both. At least one light-sensitive silver halide emulsion layer and/or at least one substantially light-insensitive hydrophilic colloidal layer in close proximity thereto comprises the interimage effect-controlling means.

In accordance with the present invention, various interimage effect-controlling means can be employed, either singly or in combination, to achieve the specified color reproduction. For example, DIR compounds can be employed in a layer of the color reversal photographic element of the invention, preferably in the cyan dye-forming unit, and more preferably in a fast red-sensitive silver halide layer in said cyan dye-forming unit. The concentration of DIR compound in the element can be about 0.002 to 0.35 $g/m^2$, preferably about 0.005 to 0.15 $g/m^2$. Useful DIR compounds can be described by the formula INH-$(TIME)_n$-CAR, wherein INH is a development inhibitor, (TIME) is a linking or timing group, n is 0, 1, or 2, and CAR is a carrier which releases the development inhibitor INH (n is 0) or the development inhibitor precursors INH-CRIME) $(TIME)_1$ or INH-$(TIME)_2$, (n is 1 or 2, respectively) upon reaction with oxidized developing agent. Subsequent reaction of INH-$(TIME)_1$ or INH-$(TIME)_2$ produces the development inhibitor INH. Useful DIR compounds include the compounds disclosed in the copending, commonly assigned application "Image Formation in Color Reversal Materials Using Strong Inhibitors," U.S. Ser. No. 08/004,027, filed Jan. 15, 1993, incorporated herein by reference. Preferred development inhibitors, which include mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, mercaptooxadiazoles, benzotriazoles, and mercaptobenzodiazoles, are disclosed in U.S. Pat. No. 5,151,343, incorporated herein by reference. Mercaptotetrazole and mercaptooxadiazole inhibitors are especially preferred.

Linking groups (TIME), when present, are groups such as esters, carbamates, and the like that undergo base-catalyzed cleavage, including anchimerically assisted hydrolysis or intramolecular nucleophilic displacement, thereby releasing INH. Where n is 2, the (TIME) groups can be the same or different. Suitable linking groups, which are also known as timing groups, are shown in the previously mentioned U.S. Pat. No. 5,151,343 and in U.S. Pat. Nos. 4,248,962, 4,847,185, 4,857,440, 4,857,447, 4,861,701, 5,021,322, 5,026,628, and the previously mentioned 5,051,345, all incorporated herein by reference. Preferred linking groups are p-hydroxyphenylmethylene moieties, as illustrated in the previously mentioned U.S. Pat. No. 5,151,343 and in Coupler D-1 of the instant application, and o-hydroxyphenyl substituted carbamate groups, also disclosed in U.S. Pat. No. 5,151,343, which undergo intramolecular cyclization in releasing INH.

Carrier groups CAR include couplers which react with oxidized color developer to form dyes and simultaneously release development inhibitors or inhibitor precursors. Other suitable carrier groups include hydroquinones, catechols, aminophenols, aminonaphthols, sulfonamidophenols, sulfonamidonaphthols, and hydrazides that undergo cross-oxidation by oxidized color developers. DIR compounds with carriers of these types are disclosed in U.S. Pat. Nos. 4,791,049 and 4,684,604, incorporated herein by reference. Preferred carrier groups are couplers that either yield colorless products, or yield dyes of similar hue to the image dyes produced by the dye-forming units with which the DIR compounds are associated. Particularly preferred are couplers that yield unballasted dyes that are removed from the photographic element during processing, such as those disclosed in the previously mentioned U.S. Pat. No. 5,151,343.

The light-sensitive silver halide emulsions in elements of the present invention can include monodisperse or polydisperse cubic, octahedral, or tabular silver halide crystals or mixtures thereof and can comprise such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized.

The emulsions typically are gelatin emulsions, although other hydrophilic colloids are useful. Negative-working octahedral silver bromoiodide emulsions are preferred. The silver bromoiodide emulsions generally contain 15 mole percent or less, preferably about 2 to 12 mole percent, of silver iodide. Tabular-grain silver halides, such as those described in U.S. Pat. No. 4,434,226, are also useful.

In accordance with the present invention, especially preferred silver bromoiodide crystals in the photosensitive emulsion layers of the element have an average silver iodide content of about 6 mole percent or less. Another interimage effect-controlling means comprises two photosensitive silver halide emulsion layers differing in color sensitivity and having a difference of at least about 1 mole percent, preferably about 1.5 to 4.5 mole percent, in average iodide content. In a preferred embodiment, the layer containing the higher iodide concentration, preferably about 4.0 to 5.5 mole percent, is red-sensitive and the layer containing the lower iodide concentration, preferably about 3.0 to 4.0 mole percent, is green- or blue-sensitive. More preferably, the higher iodide content is in a fast red-sensitive silver halide emulsion layer and the lower iodide content is in a fast green-sensitive layer.

The effect of this interimage effect-controlling means may be enhanced by placing the photosensitive layer containing the higher iodide level in close proximity to or adjacent to the layer with the lower iodide content. With reference to the schematic structure described above, if the fast red- and fast green-sensitive silver halide emulsion layers contain respectively the higher and lower iodide concentrations, layers (6) and (7) may be interchanged. Alternatively, the interchange of layers (6) and (4) together with additional interlayers may be beneficial for achieving desirable color reproduction in accordance with the invention.

In a dye-forming unit containing more than one photosensitive silver halide layer, a layer of higher sensitivity typically contains a higher concentration of dye-forming coupler per mole of silver halide than a layer of lower sensitivity. This arrangement allows the more sensitive layer to produce the requisite threshold speed and upper-scale dye density and the less sensitive layer to produce lower-scale dye density of low granularity. A further consequence is a smaller interimage effect in the lower scale than in the upper scale of a dye image.

The layers in a magenta dye-forming unit wherein a slow green-sensitive layer contains a low concentration of magenta coupler per mole of silver halide relative to the coupler:silver halide molar ratio in a fast green-sensitive layer comprise another interimage effect-controlling means that can be used in conjunction with previously described interim age effect-controlling means to produce red colors of high relative chroma simultaneously with pleasingly rendered yellow-red tints. The coupler:silver halide molar ratio in the slow green-sensitive layer is about 0.02 to 0.20, preferably about 0.04 to 0.10. In the fast green-sensitive layer, the coupler:silver halide molar ratio is about 0.10 to 0.40, preferably about 0.20 to 0.30.

In achieving the color reproduction specified in accordance with the present invention, a silver halide emulsion comprising fogged silver halide grains can be used as an interimage effect-controlling means in combination with previously described interim age effect-controlling means. The grains can be surface fogged or internally fogged, surface fogged grains being preferred. The silver halide in the fogged grains can be silver chloride, silver bromide, silver bromoiodide, silver chlorobromide, silver chloroiodide, silver chlorobromoiodide, and mixtures thereof; silver bromoidide is preferred. The mean silver halide grain size can be about 0.05 to 0.5 μm, preferably about 0.1 to 0.2 μm. The incorporation of fogged silver halide grains is described in the copending, commonly assigned application "Photographic Elements Having Fogged Grains and Development Inhibitors for Interimage," U.S. Ser. No. 08/005/472, filed Jan. 15, 1993, incorporated herein by reference.

The emulsion comprising the fogged silver halide grains can be contained in a photosensitive silver halide layer in a dye-forming unit and/or a substantially light-insensitive hydrophilic colloidal layer in close proximity thereto. The amount of fogged silver halide can be from about 0. 1 to 50 mole percent, preferably about 1 to 10 mole percent, based on the photosensitive silver halide present in the layer containing it or in a photosensitive silver halide layer in close proximity to the layer containing it.

If the dye-forming unit containing the fogged silver halide grains comprises two photosensitive silver halide emulsion layers of differing sensitivity, the fogged grains can be placed in either layer, or in both. In accordance with the present invention, fogged silver halide grains are preferably contained in the magenta dye-forming unit.

Several other techniques can be employed to enhance the result obtained from the interimage effect-controlling means in an element of the present invention. If, for example, the green- and/or blue-sensitive dye-forming units contain two or more photosensitive silver halide emulsion layers of differing sensitivity, the dye images produced in the green and/or blue-sensitive layers of lower sensitivity, i.e., the slower layers, can contain a higher proportion of red density than the dye images generated in the faster layers. This can be accomplished by using different magenta dye- and/or yellow dye-forming couplers in the slower and in the faster layers of the respective dye-forming units, the couplers in the slower layers giving dyes of broader spectral absorption and consequently higher cyan density than those contained in the faster layers. Alternatively, a small amount of cyan dye-forming coupler can be placed in the slower green- and/or blue-sensitive layers or in substantially light-insensitive hydrophilic colloidal layers in close proximity thereto.

The spectral reflectance curve for the red color standard object specified in accordance with the present invention exhibits a steep slope between about 580 and 600 nm. Green-sensitized silver halide emulsions in an element of the invention typically have maximum spectral sensitivity in the range of about 540 to 580 nm. In a preferred embodiment, the wavelength corresponding to 50 percent of maximum sensitivity on the long wavelength side of the sensitivity curve is in the range of about 575 to 585 nm.

To optimize further the result from the interimage effect-controlling means in an element of the invention containing two green-sensitized silver halide layers of differing sensitivity, the layer of lower sensitivity, i.e., the slower layer, can be sensitized to light of longer wavelength, preferably about 5 to 10 nm longer, than the layer of higher-sensitivity. Thus, for example, if the faster green-sensitive layer has maximum sensitivity at about 580 nm, the slower green-sensitive layer can be so constructed, by appropriate selection of sensitizing dye, to have maximum sensitivity at about 585–590 nm.

In another method of augmenting the result obtained from the interimage effect-controlling means in an element of the present invention, green- and/or blue-sensitive dye-forming units can contain two or more photosensitive silver halide emulsion layers of differing sensitivity, and the layers of lower sensitivity, i.e., the slower layers, can be so constructed, by choice of sensitizing dye, for example, to be proportionately more sensitive to red light than the faster layers in the respective dye-forming units.

The foregoing discussion has described a color reversal photographic element that provides the simultaneous reproduction of a red color of high relative chroma and a lower chroma yellow-red tint, for example, a skin tone, in a pleasing manner. However, simultaneous reproduction of similar colors of high and low relative chroma in other regions of color space can also be accomplished by appropriate modifications in the dye-forming units of the element. If, for example, it is desired to reproduce higher chroma green concomitantly with lower chroma greenish tint colors, interimage effect-controlling means such as the following can be employed, alone or in combination: a DIR compound incorporated in the magenta dye-forming unit; a green-sensitized silver halide emulsion layer together with a fast red-sensitized and/or a fast blue-sensitized silver halide emulsion layer, the green-sensitized layer having an average iodide content at least about 1 mole percent higher than the red-sensitized and/or the blue-sensitized layer; a cyan dye- and/or a yellow dye-forming unit that comprises silver halide emulsion layers of differing sensitivity, the slower red-sensitive layer containing a lower concentration of cyan dye-forming coupler per mole of silver halide than the faster red-sensitive layer, and/or the slower blue-sensitive layer containing a lower concentration of yellow dye-forming coupler per mole of silver halide than the faster blue-sensitive layer; a cyan dye- and/or a yellow dye-forming unit that comprises silver halide emulsion layers of differing sensitivity, the slower red- and/or blue-sensitive layers being proportionately more sensitive to green light than the corresponding faster layers; a cyan dye- and/or a yellow dye-forming unit that comprises silver halide emulsion layers of differing sensitivity, the dye images generated in the slower red- and/or blue-sensitive layers containing a higher proportion of green density than the dye images produced in the corresponding faster layers.

Should it be desired to reproduce high relative chroma blue simultaneously with lower chroma bluish tint colors, interimage effect-controlling means such as the following can be employed, alone or in combination: a DIR compound incorporated in the yellow dye-forming unit; a blue-sensitized silver halide emulsion layer together with a fast green-sensitized and/or a fast rod-sensitized silver halide emulsion layer, the blue-sensitized layer having an average iodide content at least about 1 mole percent higher than the green-sensitized an&or the red-sensitized layer; a magenta dye- and/or a cyan dye-forming unit that comprises silver halide emulsion layers of differing sensitivity, the slower green-sensitive layer containing a lower concentration of magenta dye-forming coupler per mole of silver halide than the faster green-sensitive layer, and/or the slower red-sensitive layer containing a lower concentration of cyan dye-forming coupler per mole of silver halide than the faster red-sensitive layer; a magenta dye- and/or a cyan dye-forming unit that comprises silver halide emulsion layers of differing sensitivity, the slower green- and/or red-sensitive layers being proportionately more sensitive to blue light than the corresponding faster layers; a magenta dye- and/or a cyan dye-forming unit that comprises silver halide emulsion layers of differing sensitivity, the dye images generated in the slower green- and/or red-sensitive layers containing a higher proportion of blue density than the dye images produced in the corresponding faster layers.

Further analogous modifications in the dye-forming units of the color reversal element can also be made to achieve other desirable color reproduction results such as, for example, the simultaneous production of red colors and yellow-red tint colors together with green and blue colors of high relative chroma.

In the following discussion of suitable materials for use in the emulsions and elements of this invention, reference will be made to *Research Disclosure,* December, 1989, Item 308 119, published by Kenneth Mason Publications, Ltd., Dudley Annex, 12a North Street, Emsworth, Hampshire, P010 7DQ, UK, the disclosures of which are incorporated herein by reference. This publication will be identified hereafter by the term "*Research Disclosure.*"

Couplers which form cyan dyes upon reaction with oxidized color-developing agents are described in such representative patents and publications as U.S. Pat. Nos. 2,772,162; 2,895,826; 3,002,836; 3,034,892; 2,747,293; 2,423,730; 2,367,531; 3,041,236; and 4,333,999; and Research Disclosure, Section VII D. Preferably, such couplers are phenols and naphthols.

Couplers which form magenta dyes upon reaction with oxidized color-developing agents are described in such representative patents and publications as: U.S. Pat. Nos. 2,600,788; 2,369,489; 2,343,703; 2,311,082; 3,152,896; 3,519,429; 3,062,653; and 2,908,573; and *Research Disclosure,* Section VII D. Preferably, such couplers are pyrazolones and pyrazolotriazoles.

Couplers which form yellow dyes upon reaction with oxidized and color-developing agents are described in such representative patents and publications as: U.S. Pat. Nos. 2,875,057; 2,407,210; 3,265,506; 2,298,443; 3,048,194; and 3,447,928; and *Research Disclosure,* Section VII D. Preferably, such couplers are acylacetamides such as benzoylacctanilides and pivaloylacetanilides.

Couplers which form colorless products upon reaction with oxidized color-developing agents are described in such representative patents as: UK Patent No. 861,138; U.S. Pat. Nos. 3,632,345; 3,928,041; 3,958,993; and 3,961,959. Preferably, such couplers are cyclic carbonyl-containing compounds which react with oxidized color-developing agents but do not form dyes.

The image dye-forming couplers can be incorporated in photographic elements and/or in photographic processing solutions, such as developer solutions, so that upon development of an exposed photographic element they will be in reactive association with oxidized color-developing agent. Coupler compounds incorporated in photographic processing solutions should be of such molecular size and configuration that they will diffuse through photographic layers with the processing solution. When incorporated in a photographic element, as a general rule, the image dye-forming couplers should be nondiffusible; that is, they should be of such molecular size and configuration that they will not significantly diffuse from the layer in which they are coated.

Photographic elements of this invention can be processed by conventional techniques in which color-forming couplers and color-developing agents are incorporated in separate processing solutions or compositions or in the element, as described in *Research Disclosure,* Section XIX.

Photographic elements of this invention in which the couplers are incorporated are multilayer, multicolor elements. The couplers can be incorporated in the silver halide emulsion layers and/or in adjacent layers, where they can come into reactive association with oxidized color-developing agent that has developed silver halide in the emulsion layer. The silver halide emulsion layer can contain or have associated with it other photographic coupler compounds such as additional dye-forming couplers and/or competing couplers. These other photographic couplers can form dyes of the same or different color or hue as the image dye-forming photographic couplers. Additionally, the silver halide emulsion layers and other layers of the photographic element can contain addenda conventionally contained in such layers.

A typical multilayer, multicolor photographic element can comprise a support having thereon a red-sensitive silver halide emulsion unit having associated therewith a cyan image dye-forming compound, a green-sensitive silver halide emulsion unit having associated therewith a magenta image dye-forming compound, and a blue-sensitive silver halide emulsion unit having associated therewith a yellow image dye-forming compound. Each silver halide emulsion unit can be composed of one or more layers, and the various units and layers can be arranged in different locations with respect to one another. The couplers as described can be incorporated in or associated with one or more layers or units of the photographic element.

The silver halide emulsions employed in the elements of this invention can be either negative-working or positive-working. Suitable emulsions and their preparations are described in *Research Disclosure,* Sections I and II, and the publications cited therein. The emulsions can be chemically sensitized, as described in *Research Disclosure,* Section III, and spectrally sensitized, as described in *Research Disclosure,* Section IV. Suitable vehicles for the emulsion layers and other layers of elements of this invention are described in *Research Disclosure,* Section IX, and the publications cited therein.

The photographic elements of this invention or individual layers thereof can contain brighteners (see *Research Disclosure,* Section V), antifoggants and stabilizers (see *Research Disclosure,* Section VI), antistain agents, oxidized developer scavengers, and image-dye stabilizers (see *Research Disclosure,* Section VII, I and J), light-absorbing and -scattering materials (see *Research Disclosure,* Section VIII), hardeners (see *Research Disclosure,* Section X), coating aids (see *Research Disclosure,* Section XI), plasticizers and lubricants (see *Research Disclosure,* Section XID, matting agents (see *Research Disclosure,* Section XVI) and development modifiers (see *Research Disclosure,* Section XXD.

The photographic elements can be coated on a variety of supports as described in *Research Disclosure,* Section XVII, and the references described therein.

Photographic elements can be exposed to actinic radiation, typically in the visible region of the spectrum, to form a latent image as described in *Research Disclosure,* Section XVIII, and then processed to form a visible dye image as described in *Research Disclosure,* Section XIX.

Preferred color-developing agents useful in the invention are p-phenylenediamines. Especially preferred are 4-amino-N,N-diethylaniline hydrochloride, 4-amino-3-methyl-N,N-diethylaniline hydrochloride, 4-amino-3-methyl-N-ethyl-N-á-(methanesulfonamido)ethylaniline sulfate hydrate, 4-amino-3-methyl-N-ethyl-N-á-hydroxyethylaniline sulfate, 4-amino-3-á-(methanesulfonamido)ethyl-N,N-diethylaniline hydrochloride, and 4-amino-N-ethyl-N-(2-methoxyethyl)-m-toluidine di-p-toluenesulfonic acid.

As previously described, processing of color reversal materials containing negative emulsions typically entails development with a nonchromogenic developing agent to develop exposed silver halide but not form dye, then uniform fogging of the element to render unexposed silver halide developable, and then development with a color-developing agent. Alternatively, a direct-positive emulsion can be employed to obtain a positive image.

Development is typically followed by the conventional steps of bleaching, fixing or bleach-fixing to remove silver and silver halide, washing and drying.

For forming a reversal image, typically development is followed in sequence by a reversal color development, a conditioning or pre-bleach bath, a bleach bath, a fix bath, washing, a final rinse or stabilizer bath, and drying. Such a reversal process is, for example, the previously mentioned Kodak E-6 process. For purposes of this invention, the Kodak E-6 process, or substantially equivalent processes made available by a company other than Eastman Kodak Company, are considered to be "current" or "standard" color reversal processes.

The following example further illustrates the invention.

On a cellulose triacetate film support provided with a subbing layer was coated each layer having the composition set forth below to prepare a multilayer color photographic light sensitive material, which was designated sample 101. The coating amounts shown are g/m$^2$.

| | |
|---|---|
| First layer: Antihalation layer | |
| Black colloidal silver | 0.31 (as silver) |
| Gelatin | 2.44 |
| Second layer: Intermediate layer | |
| Scavenger S-3 | 0.05 |
| Dibutyl phthalate | 0.05 |
| Gelatin | 1.22 |
| Third layer: Slow red-sensitive layer | |
| Red-sensitive silver iodobromide emulsion<br>average grain size: 0.15 μm<br>silver iodide content: 4.8% | 0.05 (as silver) |
| Red-sensitive silver iodobromide emulsion<br>average grain size: 0.29 μm<br>silver iodide content: 4.8% | 0.41 (as silver) |
| Cyan coupler C-1 | 0.17 |
| Dibutyl phthalate | 0.13 |
| Scavenger S-3 | 0.04 |
| Gelatin | 1.52 |
| Cyan absorber dye | 0.005 |
| Fourth layer: Fast red-sensitive layer | |
| Red-sensitive iodobromide emulsion<br>average grain size: 0.58 μm<br>silver iodide content: 3.4% | 1.02 (as silver) |
| Cyan coupler C-1 | 1.27 |
| Dibutyl phthalate | 0.64 |
| DIR Coupler D-1 | 0.02 |
| Tritolyl phosphates | 0.06 |
| Gelatin | 2.02 |
| Fifth layer: Intermediate layer | |
| Scavenger S-1 | 0.15 |
| Antifoggant | 0.0008 |
| Gelatin | 0.61 |
| Sixth layer: Slow green-sensitive layer | |
| Green-sensitive silver iodobromide emulsion<br>average grain size: 0.15 μm<br>silver iodide content: 4.8% | 0.32 (as silver) |
| Green-sensitive silver iodobromide emulsion<br>average grain size: 0.29 μm<br>silver iodide content: 4.8% | 0.32 (as silver) |
| Green-sensitive silver iodobromide emulsion<br>average grain size: 0.15 μm<br>silver iodide content: 4.8%<br>treated to produce 95% fog on 1st development | 0.02 (as silver) |
| Magenta coupler M-2 | 0.17 |
| Magenta coupler M-1 | 0.41 |
| Tritolyl phosphates | 0.29 |
| Scavenger S-2 | 0.02 |
| Magenta absorber dye | 0.008 |
| Gelatin | 1.08 |
| Seventh layer: Fast green-sensitive layer | |
| Green-sensitive silver iodobromide emulsion<br>average grain size: 0.70 μm<br>silver iodide content: 2% | 0.77 (as silver) |

-continued

| | |
|---|---|
| Magenta coupler M-2 | 0.31 |
| Magenta coupler M-1 | 0.71 |
| Tritolyl phosphates | 0.51 |
| Gelatin | 1.59 |
| Eighth layer: Intermediate layer | |
| Cyan absorber dye | 0.007 |
| Magenta absorber dye | 0.004 |
| Yellow absorber dye | 0.20 |
| Gelatin | 0.61 |
| Ninth layer: Yellow filter layer | |
| Carey Lea silver | 0.075 |
| Scavenger S-3 | 0.11 |
| Gelatin | 0.61 |
| Tenth layer: Slow blue-sensitive layer | |
| Blue-sensitive silver iodobromide emulsion average grain size: 0.32 μm average iodide content: 3.4% | 0.32 (as silver) |
| Blue-sensitive silver iodobromide emulsion average grain size: 0.66 μm average iodide content: 3.4% | 0.26 (as silver) |
| Yellow coupler Y-1 | 0.81 |
| Dibutyl phthalate | 0.27 |

-continued

| | |
|---|---|
| Yellow absorber dye | 0.04 |
| Gelatin | 1.35 |
| Bis(vinylsulfonylmethane) | 0.28 |
| Eleventh layer: Fast blue-sensitive layer | |
| Blue-sensitive silver iodobromide average grain size: 1.49 μm average iodide content: 2% | 1.11 (as silver) |
| Yellow coupler Y-1 | 1.67 |
| Dibutyl phthalate | 0.56 |
| Gelatin | 2.62 |
| Twelfth layer: First protective layer | |
| Ultraviolet absorbing dyes | 0.44 |
| Gelatin | 1.08 |
| Thirteenth layer: Second protective layer | |
| Carey Lea silver | 0.003 |
| Fine grained silver bromide emulsion | 0.12 |
| Matte | 0.02 |
| Gelatin | 0.86 |

Structures of couplers, scavengers, absorber dyes, and antifoggant contained in sample 101 are shown below:

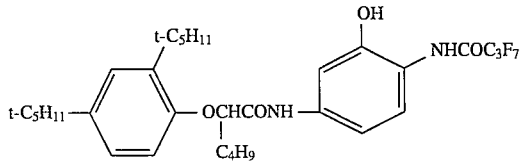

Cyan Coupler C-1

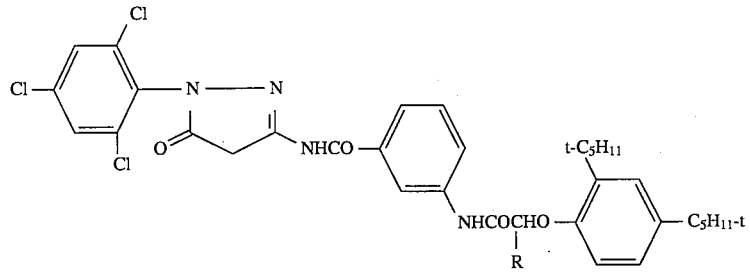

Magenta Coupler M-1 R = $C_2H_5$
Magenta Coupler M-2 R = H

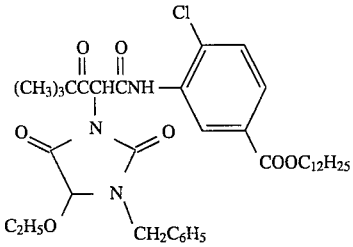

Yellow Coupler Y-1

-continued
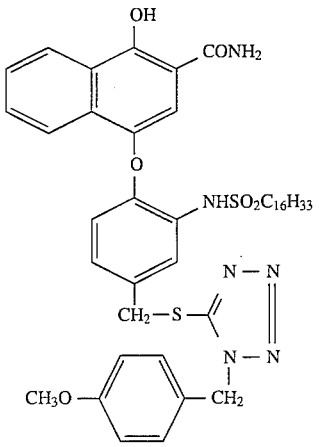
DIR Coupler D-1
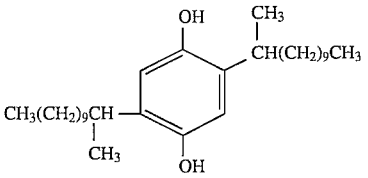
Scavenger S-1
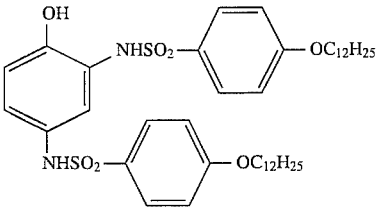
Scavenger S-2
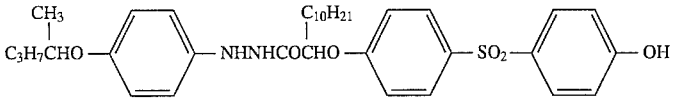
Scavenger S-3
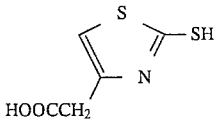
Antifoggant
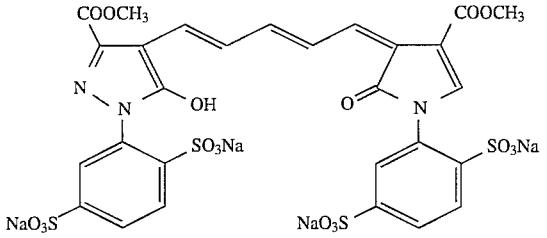
Cyan Absorber Dye -continued

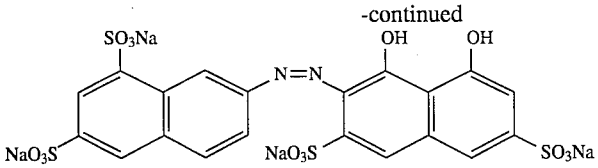

Magenta Absorber Dye

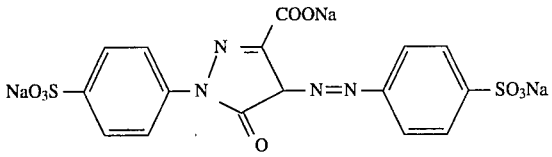

Yellow Absorber Dye

Sample 101 of the invention and samples of eighteen commercial color reversal photographic film products, designated A through R, were exposed to a chart containing a neutral, a red, and a yellow-red tint, or skin, standard test object. After exposure, all films were subjected to Kodak E-6 processing, using 4-(N-ethyl-N-2-methanesulfonamidoethyl)-2-methylphenylenediamine sesquisulfate monohydrate as color developing agent.

The test chart contained three matte reflection patches, identified below:

| | Munsell Notation | | | CIELab Values | | |
|---|---|---|---|---|---|---|
| | hue | value | chroma | a* | b* | L* |
| (1) Neutral | N | 5 | 0 | 0.18 | 0.27 | 51.10 |
| (2) Red | 7.5 R | 4 | 6 | 30.46 | 19.16 | 40.12 |
| (3) Skin | 2.2 YR | 6.47 | 4.1 | 17.26 | 18.01 | 66.98 |

The reflection patches were obtained from Munsell Color, Macbeth Division of Kollmorgen Instruments Corporation Newburgh, N.Y. The reference white for the CIELab calculations of the original patches is $D_{55}$. The standard for Munsell notation is Illuminant C (cf Davidson, Godlove, and Hemmendinger, *Journal of the Optical Society of America,* 1957, Vol. 47, p. 336). Spectral density traces from 400 to 700 nm were obtained for these reflection samples using a spectrophotometer with 45/0 geometry with black backing.

Each of the comparison and experimental films were exposed using a typical single-lens reflex camera. The photographic taking illuminant was a tungsten halogen lamp with a daylight filter producing a correlated color temperature of 7200° K. The relative Green, Red and Blue exposures of this taking illuminant compared to an ISO sensitometric daylight source (ANSI PH2.29-1985), which is the product of standard photographic daylight $D_{55}$ and the relative spectral transmittance of the ISO standard camera lens, were 0, +0.129, and +0.388, respectively. These exposure values, which define the quality of the illumination at the film plane, may be replicated through the proper combination of a lamp and selectively absorbing filters. Any taking illuminant that meets the exposure index tolerances of the ANSI sensitometric illuminant (4/0/1 for Blue/Green/Red) will suffice as the taking illuminant defined in this method.

Each of the films were exposed so that the neutral Munsell N,5,0 patch on the film corresponded to a Green Status A density of 1.0 ñ0.04. The red, skin, and neutral patches on the film that corresponded to the 1.0 density were measured with a spectrophotometer to obtain their total transmission spectral density characteristics from 400 to 700 nm. If a single film exposure did not meet the 1.0 density requirement, two exposures that bracketed the 1.0 density were spectrophotometrically measured and then linearly interpolated to obtain an approximate 1.0 Status A green density.

Reproduction coefficients (RC) for the red and the yellow-red tint, or skin, patches, which are defined as the ratio of the reproduction chroma ($C^{*R}$) to the corresponding original chroma (C*) for each patch, were determined using CIE Publication 15.2, *Colorimetry* (1986), recommendations for the 1931 CIE standard colorimetric observer (2 degree). From the reproduction coefficients (RC) determined the red and yellow-red patches, the values of the ratio of the red reproduction coefficient and the yellow-red tint, or skin, reproduction coefficient can be calculated.

To calculate CIELab values, the 1976 CIELab color space calculations recommended in CIE Publication 15.2 were used. Spectral data from 400 to 700 nm were used for the tristimulus value calculations. The reference white used in the calculation of a*, b*, and L* was the Munsell N,5,0 patch of the photographic reproduction rescaled to a Y of 100 to normalize balance differences between the films. The tristimulus values of the N,5,0 reproduction were calculated for each film assuming a $D_{55}$ viewing illuminant. These tristimulus values, which have a Y approximately 50, were reseated so that the Y value equals 100 while maintaining constant chromaticities by multiplying each of the tristimulus values by ($100/Y_{N,5,0}$). The CIELab parameters for red and yellow-red tint were calculated using the rescaled reference white.

The values of the reproduction coefficients (RC) for the red and yellow-red tint, or skin, patches and their ratios that were determined for the element of the invention and for each of the commercial color reversal film products are given in Table I below.

TABLE I

| Sample | Red RC | Yellow-Red Tint RC | Red RC/Yellow-Red Tint RC |
|---|---|---|---|
| 101 | 0.93 | 0.75 | 1.24 |
| product A | 0.94 | 0.90 | 1.05 |
| product B | 0.85 | 0.90 | 0.95 |
| product C | 0.78 | 0.86 | 0.91 |
| product D | 0.74 | 0.59 | 1.25 |
| product E | 0.74 | 0.78 | 0.95 |
| product F | 0.78 | 0.88 | 0.89 |
| product G | 0.91 | 0.83 | 1.10 |
| product H | 0.90 | 0.83 | 1.08 |
| product I | 0.73 | 0.83 | 0.88 |
| product J | 0.70 | 0.94 | 0.75 |
| product K | 0.78 | 0.86 | 0.91 |
| product L | 0.65 | 0.77 | 0.84 |

TABLE I-continued

| Sample | Red RC | Yellow-Red Tint RC | Red RC/Yellow-Red Tint RC |
|---|---|---|---|
| product M | 0.83 | 0.57 | 1.46 |
| product N | 1.02 | 1.08 | 0.95 |
| product O | 0.87 | 0.83 | 1.04 |
| product P | 0.89 | 1.02 | 0.87 |
| product Q | 0.88 | 0.89 | 0.99 |
| product R | 0.87 | 0.89 | 0.98 |

In accordance with the present invention, the red patch is reproduced with a reproduction coefficient (RC) of greater than or equal to 0.88, and the ratio of red RC/yellow-red tint RC is greater than or equal to 1.15. This describes a film that displays both red colors of high relative chroma and more accurate and pleasing skin tone rendition that is not excessively high in chroma with respect to the original. This highly desirable color reproduction position is attained with the color reversal photographic element of the invention but not with any of the commercial products included in the test.

The invention has been described in detail with particular reference to preferred embodiments thereof, but it will be understood that varians and modifications can be effected within the spirit and scope of the invention.

What is claimed is:

1. A color reversal photographic element comprising:

a support beating a red-sensitive, cyan dye-forming unit, a green-sensitive, magenta dye-forming unit, and a blue-sensitive, yellow dye-forming unit, each unit comprising a photosensitive silver halide layer and an image dye-forming coupler;

said element containing an interimage effect-controlling means;

said interimage effect-controlling means being characterized as having the capability of simultaneously forming a red image of high relative chroma and a yellow-red tint image of substantially lower relative chroma when said element is exposed to a red color standard object and a yellow-red tint color standard object and thereafter developed;

said red color standard object having CIELab values for $D_{55}$ reference white a*=30.46, b*=19.16, C*=35.98, L*=40.12;

said yellow-red tint color standard object having CIELab values for $D_{55}$ reference white a*=17.26, b*=18.01, C*=24.95, L*=66.98;

the resulting said images having a red reproduction coefficient equal to or greater than 0.88 and a ratio of red reproduction coefficient to yellow-red tint reproduction coefficient equal to or greater than 1.15.

2. An element of claim 1 wherein said interimage effect-controlling means is a DIR compound.

3. An element of claim 2 wherein said DIR compound is contained in said element at a concentration of about 0.005 to 0.15 g/m$^2$.

4. An element of claim 3 wherein said DIR compound is contained in said cyan dye-forming unit.

5. An element of claim 4 wherein said cyan dye-forming unit comprises a fast red-sensitive silver halide layer and a slow red-sensitive silver halide layer and wherein said DIR compound is contained in said fast red-sensitive silver halide layer.

6. An element of claim 5 wherein said DIR compound is a dye-forming coupler.

7. An element of claim 1 wherein said magenta dye-forming unit comprises a slow green-sensitive silver halide layer in which the molar ratio of magenta dye-forming coupler to silver halide is about 0.02 to 0.20 and a fast green-sensitive silver halide layer in which the molar ratio of magenta dye-forming coupler to silver halide is about 0.10 to 0.40.

8. An element of claim 7 wherein the molar ratio of coupler to silver halide in said slow green-sensitive silver halide layer is about 0.04 to 0.10 and the molar ratio of coupler to silver halide in said fast green-sensitive silver halide layer is about 0.20 to 0.30.

9. An element of claim 1 that contains fogged silver halide grains.

10. An element of claim 9 wherein said fogged silver halide grains are contained in said magenta dye-forming unit.

11. An element of claim 9 wherein said fogged silver halide grains are contained in a substantially light-insensitive hydrophilic colloidal layer adjacent to said magenta dye-forming unit.

12. An element of claim 10 wherein said fogged silver halide grains in said magenta dye-forming unit are contained in a slow green-sensitive silver halide layer.

13. An element of claim 12 wherein said fogged silver halide grains are silver bromoiodide grains.

14. An element of claim 13 wherein said green-sensitive silver halide emulsion layer contains said fogged silver halide grains at a concentration of about 0.5 to 5 percent by weight of green-sensitive silver halide.

15. An element of claim 2 wherein said DIR compound is of the formula:

$$\text{INH-(TIME)}_n\text{—CAR}$$

wherein: INH is a development inhibitor; (TIME) is a linking or timing group; n is 0, 1 or 2; and CAR is a coupler which reacts with oxidized developer and simultaneously releases the development inhibitor INH when n is 0 or the development inhibitor precursors INH-$(TIME)_1$ or INH-$(TIME)_2$ when n is 1 or 2, respectively.

16. An element of claim 4 wherein said DIR compound is of the formula:

$$\text{INH-(TIME)}_n\text{—CAR}$$

wherein: INH is a development inhibitor; (TIME) is a linking or timing group; n is 0, 1 or 2; and CAR is a coupler which reacts with oxidized developer and simultaneously releases the development inhibitor INH when n is 0 or the development inhibitor precursors INH-$(TIME)_1$ or INH-$(TIME)_2$ when n is 1 or 2, respectively.

* * * * *

UNITED STATES PATENT AND TRADEMARK OFFICE

CERTIFICATE OF CORRECTION

PATENT NO. : 5,576,158

DATED : Nov. 19, 1996

INVENTOR(S) : F. E. Ford, et al

It is certified that error appears in the above-indentified patent and that said Letters Patent is hereby corrected as shown below:

Column 19, line 27, should read,

-- a support bearing a red-sensitive, cyan dye-forming unit, --

Signed and Sealed this

Eleventh Day of March, 1997

Bruce Lehman

*Attest:*

BRUCE LEHMAN

*Attesting Officer*

*Commissioner of Patents and Trademarks*